US012188316B2

(12) United States Patent
Tonti et al.

(10) Patent No.: US 12,188,316 B2
(45) Date of Patent: Jan. 7, 2025

(54) DOWNHOLE INFLATION TOOL AND INFLATABLE DEVICE

(71) Applicant: INNOVEX DOWNHOLE SOLUTIONS, INC., Houston, TX (US)

(72) Inventors: Nick Tonti, Houston, TX (US); Chris Cuffe, The Woodlands, TX (US); Mark Reddout, Houston, TX (US)

(73) Assignee: INNOVEX DOWNHOLE SOLUTIONS, INC., Houston, TX (US)

( * ) Notice: Subject to any disclaimer, the term of this patent is extended or adjusted under 35 U.S.C. 154(b) by 0 days.

(21) Appl. No.: 18/044,997

(22) PCT Filed: Sep. 13, 2021

(86) PCT No.: PCT/US2021/050035
§ 371 (c)(1),
(2) Date: Mar. 13, 2023

(87) PCT Pub. No.: WO2022/060664
PCT Pub. Date: Mar. 24, 2022

(65) Prior Publication Data

US 2023/0349252 A1 Nov. 2, 2023

Related U.S. Application Data

(60) Provisional application No. 63/080,157, filed on Sep. 18, 2020.

(51) Int. Cl.

| | |
|---|---|
| ***E21B 23/06*** | (2006.01) |
| ***E21B 33/127*** | (2006.01) |
| *E21B 23/04* | (2006.01) |

(52) U.S. Cl.
CPC ..... *E21B 23/065* (2013.01); *E21B 23/06* (2013.01); *E21B 33/127* (2013.01); *E21B 23/0412* (2020.05)

(58) Field of Classification Search
CPC .... E21B 23/065; E21B 33/127; E21B 23/042; E21B 23/0417
See application file for complete search history.

(56) References Cited

U.S. PATENT DOCUMENTS

| | | | |
|---|---|---|---|
| 9,885,233 | B2 | 2/2018 | Wayne et al. |
| 2019/0242205 | A1 | 8/2019 | Davis et al. |
| 2020/0157902 | A1 | 5/2020 | Covalt et al. |
| 2020/0256156 | A1 | 8/2020 | Rosenthal |

OTHER PUBLICATIONS

International Search Report and Written opinion dated Dec. 24, 2021, PCT Application No. PCT/US2021/050035 11 pages.

*Primary Examiner* — Yong-Suk (Philip) Ro
(74) *Attorney, Agent, or Firm* — MH2 Technology Law Group, LLP

(57) ABSTRACT

A downhole tool and method, of which the downhole tool includes a housing defining a charge chamber and a hydraulic chamber, the hydraulic chamber containing a hydraulic fluid, and a piston disposed in the hydraulic chamber. The piston prevents the hydraulic fluid from communicating with the charge chamber, and is in communication with the hydraulic fluid and the charge chamber. The tool also includes one or more charges disposed in the charge chamber. The one or more charges are configured to ignite and thereby expand a gas in the charge chamber. The tool further includes a fluid-metering device coupled to the housing. The fluid-metering device is configured to control a rate at which the hydraulic fluid is pressed out of the hydraulic chamber.

21 Claims, 7 Drawing Sheets

DOWNHOLE INFLATION TOOL AND INFLATABLE DEVICE

CROSS-REFERENCE TO RELATED APPLICATIONS

This application is a U.S. National Stage application of PCT/US2021/050035, filed Sep. 13, 2021, which claims priority to U.S. Provisional Patent Application Ser. No. 63/080,157, which was filed on Sep. 18, 2020. Each of these priority documents is incorporated herein by reference in its entirety.

BACKGROUND

In the oil and gas field, packers are used to isolate one wellbore region from another for a variety of different reasons, but often for pressure-containment purposes. Packers are generally deployed or "run" into the wellbore in a run-in configuration, and then actuated to a set configuration when they reach a desired depth in the well. Oftentimes, packers need to be able to pass through restrictions in a well, and thereafter increase in radial dimension to seal against a surrounding tubular that is larger in diameter than the restriction. Accordingly, packers may increase in radial dimension when actuated from the run-in configuration to the set configuration. Such radial size increase may be caused by swelling, inflating, or mechanically compressing a sealing element such that it expands outward.

SUMMARY

Embodiments of the disclosure provide a downhole tool including a housing defining a charge chamber and a hydraulic chamber, the hydraulic chamber containing a hydraulic fluid, and a piston disposed in the hydraulic chamber. The piston prevents the hydraulic fluid from communicating with the charge chamber, and is in communication with the hydraulic fluid and the charge chamber. The tool also includes one or more charges disposed in the charge chamber. The one or more charges are configured to ignite and thereby expand a gas in the charge chamber. The tool further includes a fluid-metering device coupled to the housing. The fluid-metering device is configured to control a rate at which the hydraulic fluid is pressed out of the hydraulic chamber.

Embodiments of the disclosure also provide a method including charging an inflation tool using one or more charges and a hydraulic fluid, connecting the inflation tool to an inflatable device, deploying the inflation tool and the inflatable device into a wellbore, and activating the inflation tool by igniting the one or more charges. Activating the inflation tool forces at least some of the hydraulic fluid into the inflatable device, and at least some of the hydraulic fluid that is forced into the inflatable device presses an inflatable element radially outward into engagement with a surrounding tubular.

Embodiments of the disclosure also provide a downhole tool including a housing defining a charge chamber and a hydraulic chamber, a piston disposed in the hydraulic chamber. The piston prevents a hydraulic fluid in the hydraulic chamber from communicating with the charge chamber, and the piston is in communication with the hydraulic fluid and the charge chamber. The tool further includes one or more charges disposed in the charge chamber, and an inflatable element coupled to the housing. The piston is configured to move from a first position that is proximal to the charge chamber, to a second position in the hydraulic chamber by pressure generated by igniting the one or more charges. The piston moving from the first position to the second position displaces the hydraulic fluid and causes the inflatable element to inflate.

BRIEF DESCRIPTION OF THE DRAWINGS

The present disclosure may best be understood by referring to the following description and accompanying drawings that are used to illustrate some embodiments. In the drawings.

DETAILED DESCRIPTION

Figure 1:
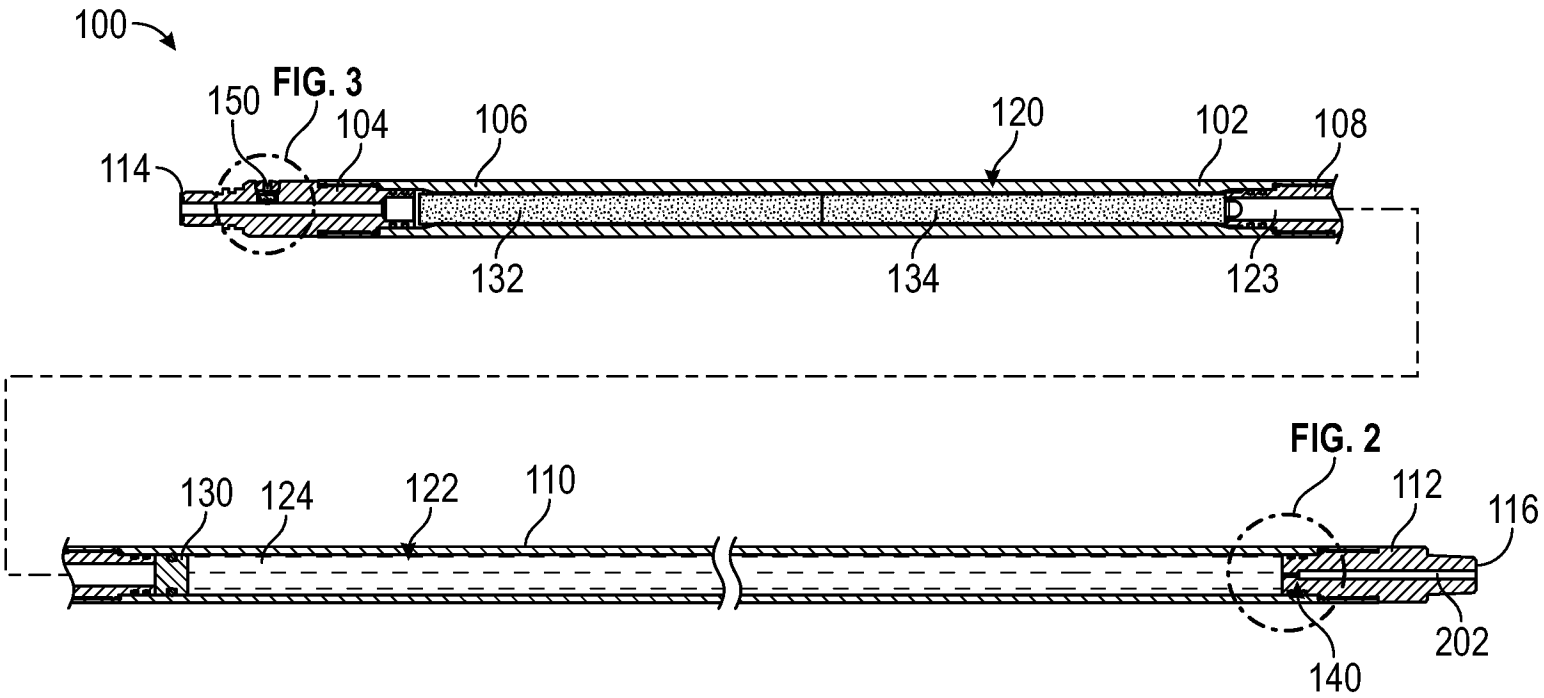
FIG. 1 illustrates a side, cross-sectional view of an inflation tool, according to an embodiment.

The following disclosure describes several embodiments for implementing different features, structures, or functions of the invention. Embodiments of components, arrangements, and configurations are described below to simplify the present disclosure; however, these embodiments are provided merely as examples and are not intended to limit the scope of the invention. Additionally, the present disclosure may repeat reference characters (e.g., numerals) and/or letters in the various embodiments and across the Figures provided herein. This repetition is for the purpose of simplicity and clarity and does not in itself dictate a relationship between the various embodiments and/or configurations discussed in the Figures. Moreover, the formation of a first feature over or on a second feature in the description that follows may include embodiments in which the first and second features are formed in direct contact, and may also include embodiments in which additional features may be formed interposing the first and second features, such that the first and second features may not be in direct contact. Finally, the embodiments presented below may be combined in any combination of ways, e.g., any element from one exemplary embodiment may be used in any other exemplary embodiment, without departing from the scope of the disclosure.

Additionally, certain terms are used throughout the following description and claims to refer to particular components. As one skilled in the art will appreciate, various entities may refer to the same component by different names, and as such, the naming convention for the elements described herein is not intended to limit the scope of the invention, unless otherwise specifically defined herein. Further, the naming convention used herein is not intended to distinguish between components that differ in name but not function. Additionally, in the following discussion and in the claims, the terms "including" and "comprising" are used in an open-ended fashion, and thus should be interpreted to mean "including, but not limited to." All numerical values in this disclosure may be exact or approximate values unless otherwise specifically stated. Accordingly, various embodiments of the disclosure may deviate from the numbers, values, and ranges disclosed herein without departing from the intended scope. In addition, unless otherwise provided herein, "or" statements are intended to be non-exclusive; for example, the statement "A or B" should be considered to mean "A, B, or both A and B."

FIG. 1 illustrates a side, cross-sectional view of an inflation tool 100, according to an embodiment. The inflation tool 100 may be configured to contain fluid (e.g., hydraulic fluid) therein, and then to expel the fluid so as to inflate an inflatable device (e.g., subjacent to the inflation tool 100). A packer is an example of such an inflatable device, and the inflation tool 100 will be discussed below with reference to inflating such a packer; however, it will be understood that the inflation tool 100 may be readily employed with other types of devices, whether inflatable or otherwise actuated by hydraulic fluid.

The inflation tool 100 may include a cylindrical housing 102. The housing 102 may be a single, unitary structure, or may be made from two or more components that are connected together. For example, in this embodiment, the housing 102 includes an upper sub 104, a first outer housing 106, a connector sub 108, a second outer housing 110, and a lower sub 112. As shown, the upper sub 104 may be threaded into the first outer housing 106, the first outer housing 106 may be threaded onto the connector sub 108, the connector sub 108 may be threaded into the second outer housing 110, and the second outer housing 110 may be threaded onto the lower sub 112. It will be appreciated that any of these components may be combined with the other, e.g., formed from a single piece, and/or any of these components may be made from two or more pieces that are connected together.

The housing 102 may have an upper end 114 and a lower end 116. For example, the upper sub 104 may include the upper end 114 and the lower sub 112 may include the lower end 116. The upper and lower ends 114, 116 may be threaded, e.g., externally (male), for connection with adjacent tubulars or other devices. For example, the upper end 114 may be connected to an ignition assembly, which may include a check valve and an electrical igniter. The lower end 116 may be connected to a subjacent tool, such as a packer, as will be described in greater detail below.

The housing 102 may define a charge chamber 120 and a hydraulic chamber 122 therein. For example, the charge chamber 120 may be located within the first outer housing 106, e.g., generally proximal to the upper end 114 of the housing 102. The hydraulic chamber 122 may be located within the second outer housing 110, e.g., generally proximal to the lower end 116. The connector sub 108 may separate the hydraulic chamber 122 from the charge chamber 120, and a bore 123 extending through the connector sub 108 may permit communication therebetween. In some embodiments, the bore 123 may be smaller in radial dimension than the hydraulic chamber 122 and the charge chamber 120.

A piston 130 may be positioned in the hydraulic chamber 122 and may be movable therein. For example, the hydraulic chamber 122 may be loaded with a hydraulic fluid 124, which may, in a run-in configuration, substantially fill the hydraulic chamber 122 between the piston 130 and the lower sub 112.

The piston 130 may be configured to move in the hydraulic chamber 122 under force applied by expanding gasses in the charge chamber 120. In particular, the charge chamber 120 may include one or more charges (two shown: 132, 134). The charges 132, 134 may be positioned end-to-end, or "in series" such that the charge 134 ignites after the charge 132. The igniter (connected to the upper end 114) may initiate such ignition in a conventional manner. The number of charges 132, 134 may be selected to produce a predetermined force and a predetermined amount of time that force is to be applied on the piston 130 and eventually to the subjacent tool, as will be described in greater detail below. Accordingly, additional charges 132, 134 may be associated with the application of a higher pressure, over a longer period of time, or both. Moreover, the charges 132, 134 may be of a standard size, such that they are readily commercially available.

Figure 2:
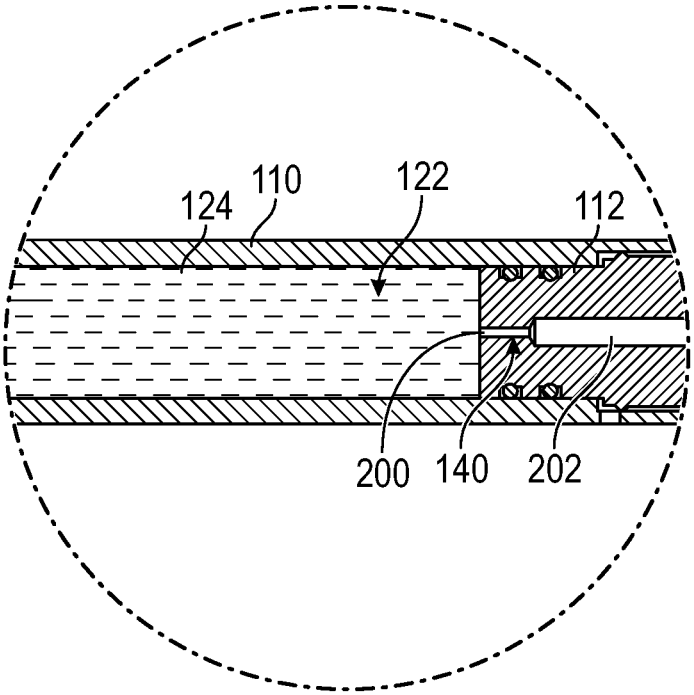
FIG. 2 illustrates an enlarged view of a flow metering device of the inflation tool, according to an embodiment.

The lower sub 112 may include a fluid-metering device 140. FIG. 2 illustrates the fluid-metering device 140 in greater detail. As shown, the fluid-metering device 140 may include an orifice 200. The orifice 200 may extend an axial length into the lower sub 112 and may be connected to a bore 202, which may be larger in radial dimension than the orifice 200. As such, the orifice 200 may restrict the flow rate of fluid from the hydraulic chamber 122 to the bore 202, e.g., based at least in part on the viscosity of the hydraulic fluid 124 and the pressure applied thereto by the piston 130. The bore 202 may extend through the lower end 116 and communicate with the subjacent, inflatable device, so as to provide the hydraulic fluid thereto. In other embodiments, the fluid-metering device 140 could include additional or other components configured to slow a fluid flow therethrough, e.g., flappers, nozzles, plates, etc.

Figure 3:
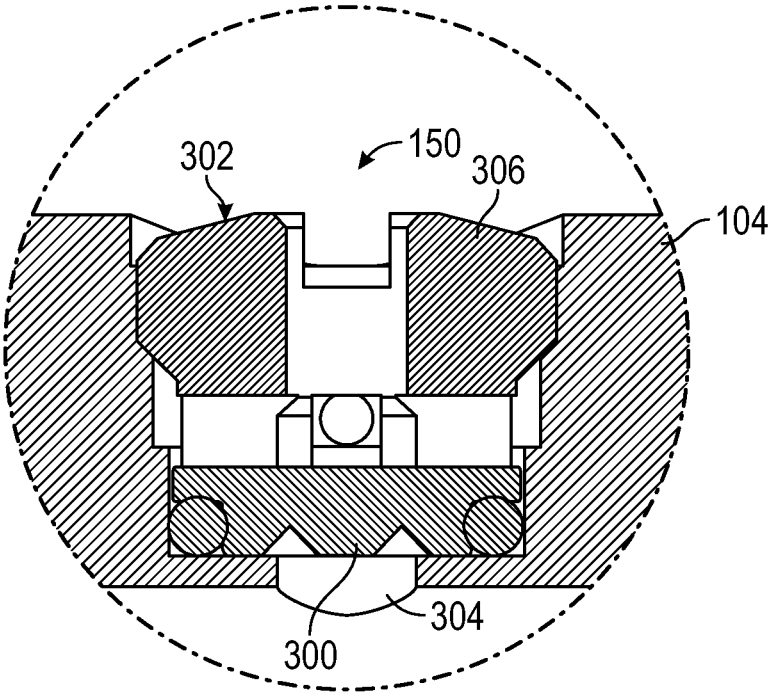
FIG. 3 illustrates an enlarged view of a pressure-relief device of the inflation tool, according to an embodiment.

Referring again to FIG. 1, the upper sub 104 may include a pressure-relief device 150. FIG. 3 illustrates an enlarged view of the pressure-relief device 150, according to an embodiment. The pressure-relief device 150 may include a rupture disk 300, which may be disposed in a pocket 302 extending radially inward through the upper sub 104. A port 304 may extend outward from the interior of the upper sub 104. Further, a ported plug 306 may be disposed in the pocket 304, so as to retain the rupture disk 300 in place within the pocket 304 and/or otherwise protect the rupture disk 300.

While it is intact, the rupture disk 300 may prevent communication between the interior and exterior of the upper sub 104 via the port 304 and pocket 302. Once the rupture disk 300 is ruptured, however, the fluid communication may be established between the interior and exterior of the upper sub 104, which may allow for gas at relatively high pressure (e.g., after the pressure charge(s) 132, 134 have ignited) to be released from within the charge chamber 120.

Figure 4:
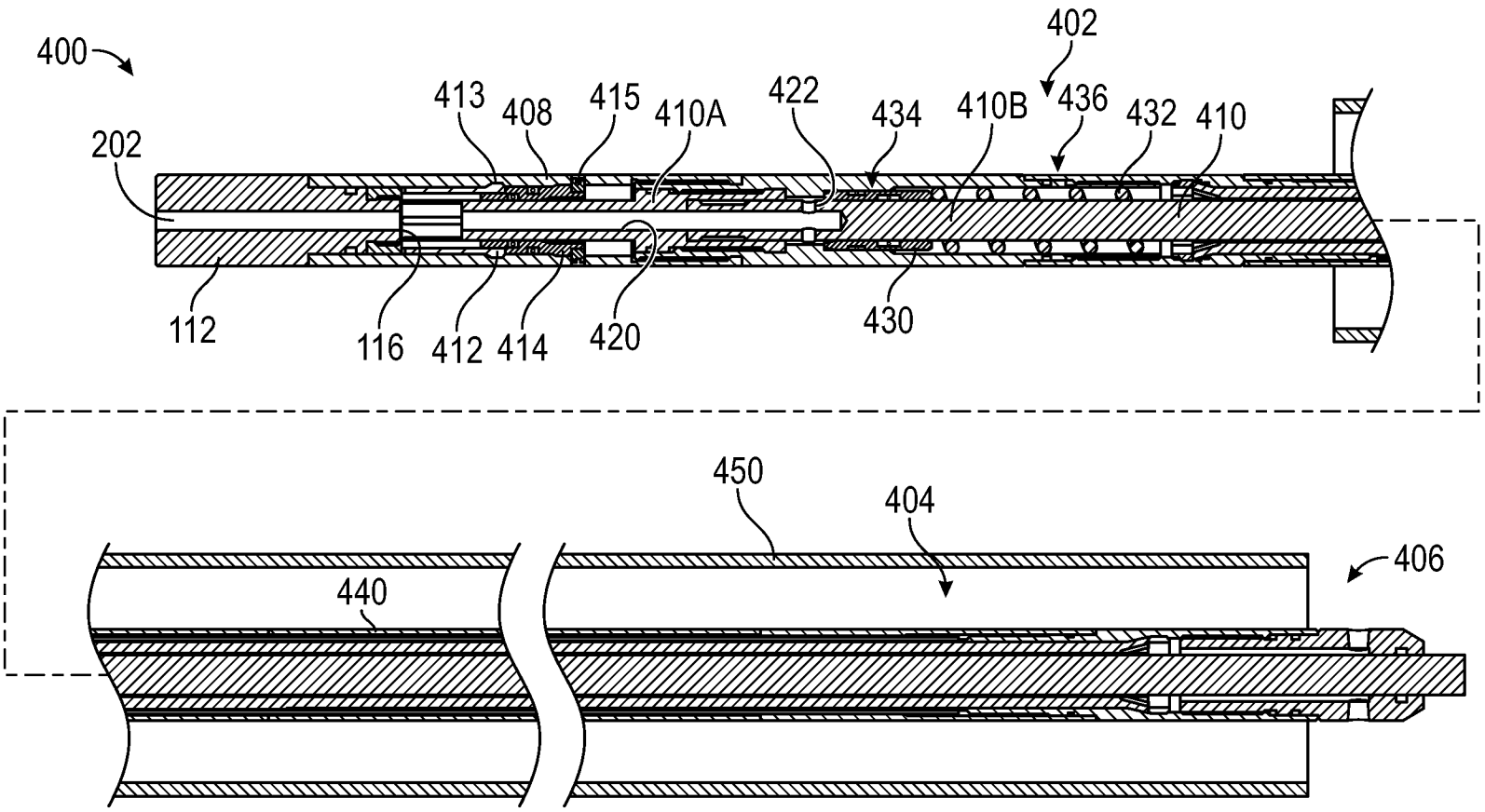
FIG. 4 illustrates a side, cross-sectional view of an inflatable device that is run into a surrounding tubular, according to an embodiment.

FIG. 4 illustrates a side, cross-sectional view of an inflatable device 400 that is run into a surrounding tubular 450 (e.g., casing, liner, or the wellbore wall in the case of an open hole), according to an embodiment. In this embodiment, the inflatable device 400 is a packer; however, other embodiments may provide different tools. The inflatable device 400 may be connected to the lower end 116 of the of the inflation tool 100, as will be described according to an example, below. As such, the inflatable device 400 may be referred to as being "subjacent" to the inflation tool 100. Subjacent is merely intended to refer to one element being deeper than (below) another when run into a well, and not to necessarily imply a direct connection therebetween (e.g., one or more components may be between the tool 100 and the device 400 while the device 400 may be considered subjacent to the tool 100).

In this example, the inflatable device 400 generally includes a connection/actuation assembly 402, an inflatable assembly 404, and a lower ring assembly 406. In an embodiment, the connection/actuation assembly 402 includes a housing 408, which may be received onto the lower sub 112 of the tool 100. An inner mandrel 410 may extend at least partially through the housing 408, but may be separated axially apart from the lower end 116 of the tool 100, such that fluid is able to move through the bore 202 in the lower sub 112 and around the outside of the end of the inner mandrel 410. In some embodiments, the inner mandrel 410 may be provided by two (or more) mandrel portions 410A, 410B that are connected together, but in other embodiments, the mandrel 410 may be a single piece.

A collet 412 may also be disposed in the housing 408 and may be received into a recess 413 formed in the housing 408 so as to secure the lower end 116 in position, at least axially, relative to the housing 408. A release piston 414 may be positioned radially between the housing 408 and the inner mandrel 410, and at least partially between the collet 412 and the inner mandrel 410. The release piston 414 may be held in position by a shear screw 415 (or any other member configured to shear or otherwise release under a predetermined force) that is connected to the housing 408. Accordingly, the piston 414 may be prevented from moving relative to the housing 408 and may prevent the collet 412 from deflecting radially inwards toward the inner mandrel 410, which in turn prevents the device 400 from decoupling from the tool 400.

At least a portion of the inner mandrel 410 defines a bore 420 therein. For example, the bore 420 may extend through the mandrel portion 410A and into, but not through, the mandrel portion 410B. The bore 420 is thus in communication with the bore 202 through the lower sub 112 and thus in communication with the hydraulic chamber 122 (FIG. 1) via the fluid-metering device 140. The inner mandrel 410, e.g., the mandrel portion 410B, also includes one or more radial ports 422 therein, which communicate with the bore 420 and a portion of the annulus between the inner mandrel 410 and the housing 408, as shown.

A poppet valve element 430 may be positioned radially between the housing 408 and the inner mandrel 410, e.g., the mandrel portion 410B. The poppet valve element 430 may be in communication with the ports 422. Further, a biasing member 432 (e.g., spring) may engage and bias the poppet valve element 430 into a reduced-diameter section 434 of the housing 408. In the reduced-diameter section 434, the poppet valve element 430 seals the annulus between the housing 408 and the inner mandrel 410. When pressure applied via the ports 422 onto the poppet valve element 430 generates a force that exceeds the biasing force of the biasing member 432, the poppet valve element 430 may slide out of the reduced-diameter section 434 into an enlarge diameter section 436 of the housing 408. The poppet valve element 430 may be configured not to seal with the housing 408 and/or mandrel 410 in the enlarged-diameter section 436. As such, fluid received through the ports 422 may be able to flow around the poppet valve element 430, when the poppet valve element 430 is moved out of the reduced-diameter section 434.

The inflatable assembly 404 may include an inflatable element 440, which may be a rubber element or another type of flexible member that is received around and connected to the mandrel 410. An interior of the inflatable element 440, between the inflatable element 440 and the mandrel 410 may be in communication with the enlarged-diameter section 436 of the housing 408. Accordingly, fluid received around the poppet valve element 430 and into the enlarged-diameter section 436 may then proceed into the area between the inflatable element 440 and the mandrel 410, which may deform the inflatable element 440 radially outward, e.g., into engagement with a surrounding tubular 450.

The lower ring assembly 406 may also be connected to the mandrel 410 and the inflatable element 440. The lower ring assembly 406 may be configured to retain pressure within the inflatable element 440 and locate the inflatable element 440 in position on the mandrel 410, at least initially.

Figure 5:
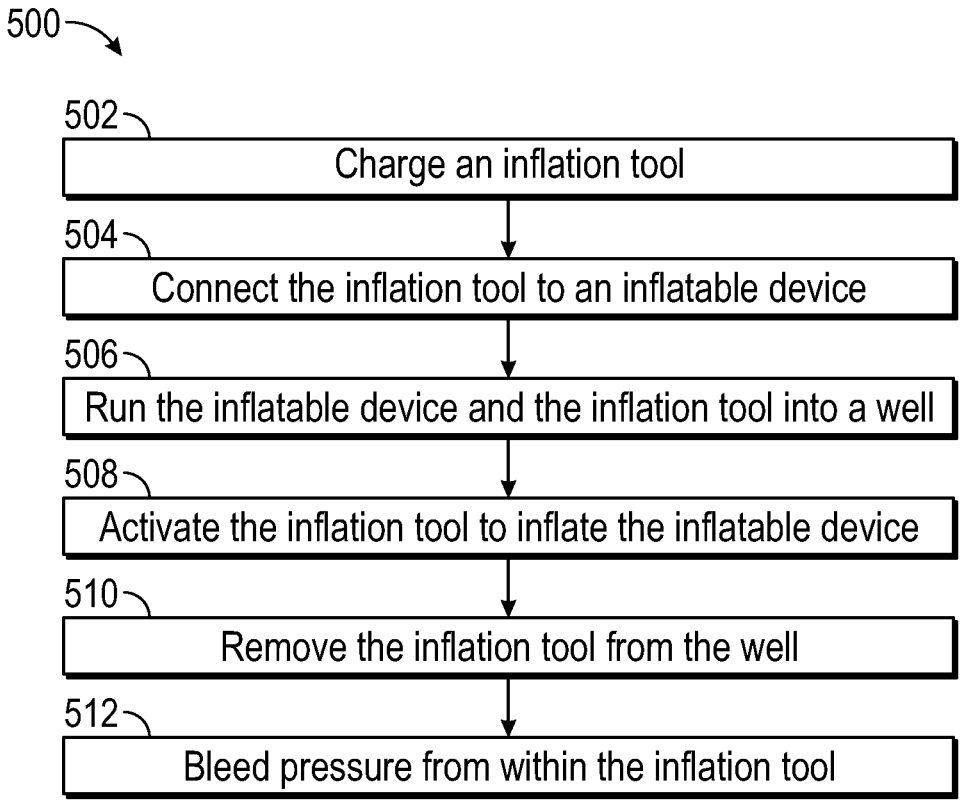
FIG. 5 illustrates a flowchart of a method for operating an inflation tool to inflate an inflatable device, according to an embodiment.

FIG. 5 illustrates a flowchart of a method 500 for operating an inflation tool, such as the inflation tool 100, in order to inflate an inflatable device, such as the inflatable device 400, according to an embodiment. Reference will be made to FIGS. 1 and 4 for the initial stages of the method 500, and then reference will be made to FIGS. 6A, 6B, 7A, and 7B, which show the inflation tool 100 and the inflatable device 400 in subsequent stages of operation, according to an embodiment.

The method 500 includes charging the inflation tool 100, as at 502. Charging the inflation tool 100 may include selecting a number of charges (e.g., the two charges 132, 134 of FIG. 1) based on a desired actuation pressure and/or time, and positioning the selected number of charges 132, 134 into the charge chamber 120. Charging the inflation tool 100 may also include filling the hydraulic chamber 122 with a hydraulic fluid 124 (e.g., a viscous oil).

Before, during, or after charging the inflation tool 100, the method 500 may include connecting the inflation tool 100 to an inflatable device 400, as at 504, e.g., directly or via one or more intermediary components. For example, a releasable, collet-based connection may be employed to connect the tool 100 and the device 400; however, shearable members such as shear threads, screws, etc., or other types of releasable connections could also be used to connect the tool 100 and device 400 together in a manner that is releasable in the wellbore.

Once connected together, the tool 100 and the device 400 may be run into a well, e.g., as part of a string of tubulars, as at 506. When the inflatable device 400 reaches a desired position in the well, the inflation tool 100 may be actuated to inflate the inflatable device 400, as at 508. For example, the inflation tool 100 may be actuated by electric signal to an ignition assembly that is also connected to (e.g., an upper end 114 of) the inflation tool 100. This may result in the charges 132, 134 igniting, e.g., sequentially with the charge 132 closest to the upper end 112 igniting first, and then the next closest charge 134, etc. As the charges 132, 134 ignite, heat is generated, which rapidly expands the gas in the charge chamber 120. This expanding gas builds up pressure against the piston 130. In response, the piston 130 advances into the hydraulic chamber 122, which expels the hydraulic fluid therein through the bore 220. However, the fluid-metering device 140 ensures that this expulsion is relatively slow and controlled, despite the relatively rapid expansion of the gas and associated pressure build-up behind the piston 130.

Proceeding from FIG. 1 to FIG. 4, as the hydraulic fluid is expelled through the bore 220, it is received into tool 400, e.g., into the housing 408. The fluid is initially prevented from displacing the release piston 412, which is secured to the housing 408, and thus the inflation tool 100 remains coupled to the device 400. The fluid flows through the bore 420, out the ports 422, and into communication with the poppet valve element 430. When the pressure of the fluid against the poppet valve element 430 overcomes the force applied by the biasing member 432, the poppet valve element 430 moves out of the reduced-diameter section 434 and into the enlarged-diameter section 436. This permits the hydraulic fluid 124 that is received from the inflation tool 100 to move into the area between the mandrel 410 and the inflatable element 440. That is, the hydraulic fluid 124 that was initially in the inflation tool 100 is displaced therefrom into the inflation device 400 and directly inflates the inflatable element 440 therein, pressing it radially outwards, e.g., without the use of intervening devices that convert the pressure in the hydraulic fluid 124 to a different kind of movement or energy, which is then used to inflate the inflatable element 440.

Figure 6A:
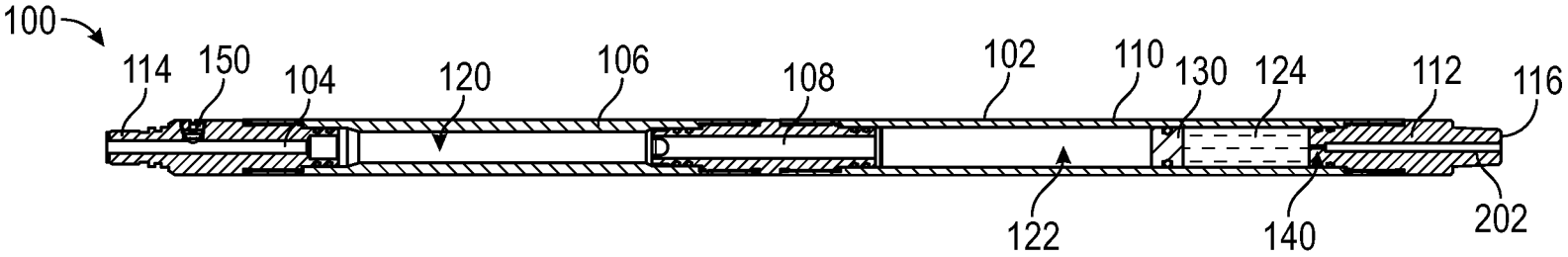
FIG. 6A illustrates a side, cross-sectional view of the inflation tool in a second stage of operation, according to an embodiment.
Figure 6B:
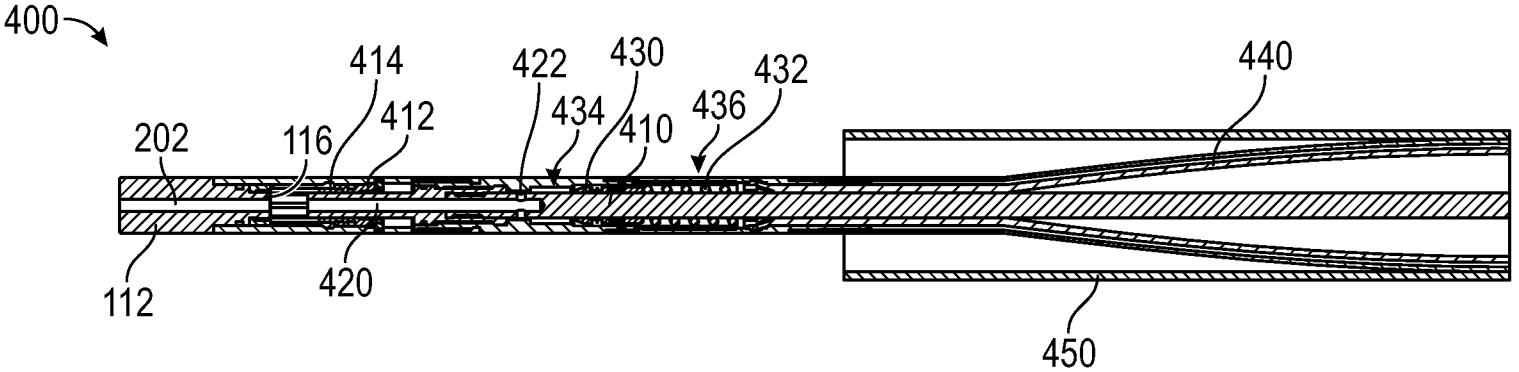
FIG. 6B illustrates a side, cross-sectional view of the inflatable device in a second stage of operation, according to an embodiment.

FIG. 6A illustrates a second stage of operation of the tool 100, which corresponds to the state of the inflatable device 400 in FIG. 6B. In this stage, the charges 132, 134 may be at least partially spent, and the piston 130 may have advanced to a second position, which is sufficiently into the hydraulic chamber 124 that the poppet valve element 430 is opened and allowed the inflatable element 440 to inflate and deform radially outward until engaging with (e.g., sealing against) the surrounding tubular 450. The piston 130 may continue to apply pressure on the hydraulic fluid, however, even if the charges 132, 134 are no longer igniting, e.g., as the gas has still expanded. However, the inflatable element 440 may not be further inflatable, as it is engaging the surrounding tubular 440. Accordingly, pressure may build against the release piston 414, until the shear screw 415, the intentional weak link, shears, and releases the release piston 414 to slide relative to the housing 408 and the mandrel 410. When such sliding occurs, the collet 412 is permitted to deflect radially inwards, out of the recess 413. In turn, this releases the connection between the tool 100 and the device 400.

Figure 7A:
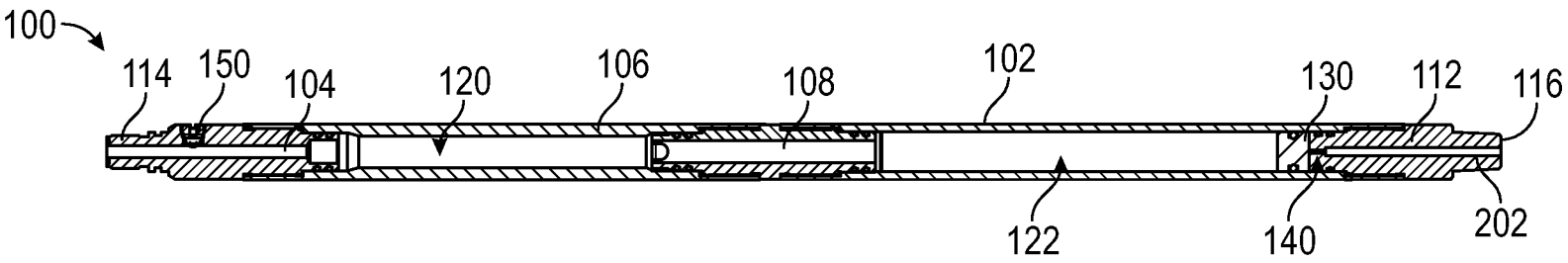
FIG. 7A illustrates a side, cross-sectional view of the inflation tool in a third stage of operation, according to an embodiment.
Figure 7B:
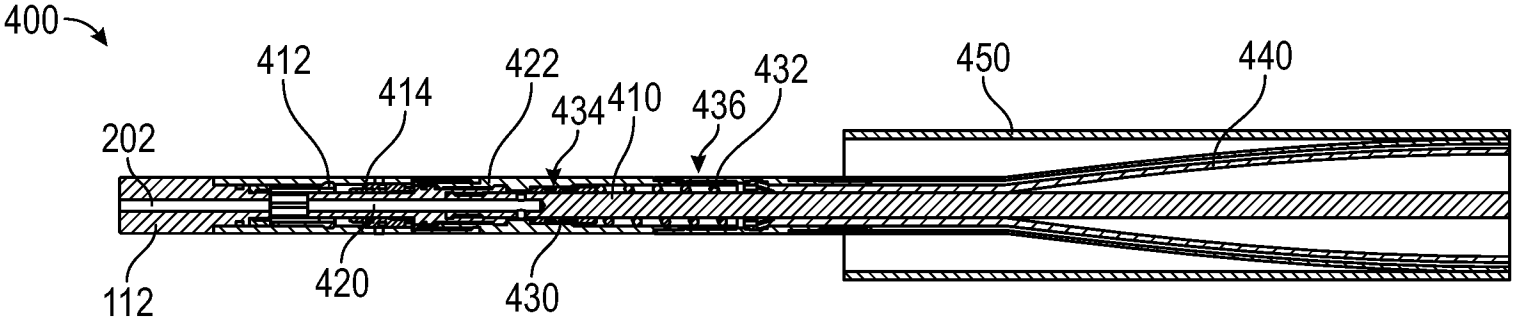
FIG. 7B illustrates a side, cross-sectional view of the inflatable device in a third stage of operation, according to an embodiment.

FIGS. 7A and 7B illustrate the tool 100 and the device 400 when the connection therebetween is broken, e.g., in FIG. 7B, allowing the release piston 414 to be released from its connection with the housing 408 and the collet 412 to deflect radially inwards. Specifically referring to FIG. 7A, when the connection between the tool 100 and 400 is broken, the pressure of the hydraulic fluid 124 on the poppet valve element 430 may reduce, and thus the biasing member 432 may force the poppet valve element 430 back into sealing engagement with the reduced-diameter section 432 of the housing 408 and the mandrel 410. As such, the hydraulic fluid 124 received from within the inflation tool 100 is retained within the inflatable device 400, thereby preventing the inflatable element 440 from deflating. The remainder of the hydraulic fluid 124 may be forced out of the hydraulic chamber 122, again under pressure applied by the gas in the charge chamber 120 that expanded by igniting the charges 132, 134, and may progress into the wellbore. The piston 130 may thus land on the lower sub 112 and seal the bore 220, preventing the expanded gas from escaping therethrough. This may be a third position of the piston 130. Another valve, e.g., in the igniter assembly above the upper end 114, may prevent escape of the gases in the uphole direction, resulting in a residual inflation pressure being left within the inflation tool 100.

Referring again to FIG. 5, once the connection is broken, the method 500 may include pulling the inflation tool 100 out of the well, while the inflatable device 400 remains in the well, as at 510. In various embodiments, the inflatable device 400 may be removed or retrieved later, after it has served its function (e.g., isolating one wellbore section from another). The residual inflation pressure contained within the tool 100 may then be bled off, as at 512, e.g., by rupturing the pressure-relief device 150 (e.g., frangible disk).

Figure 8:
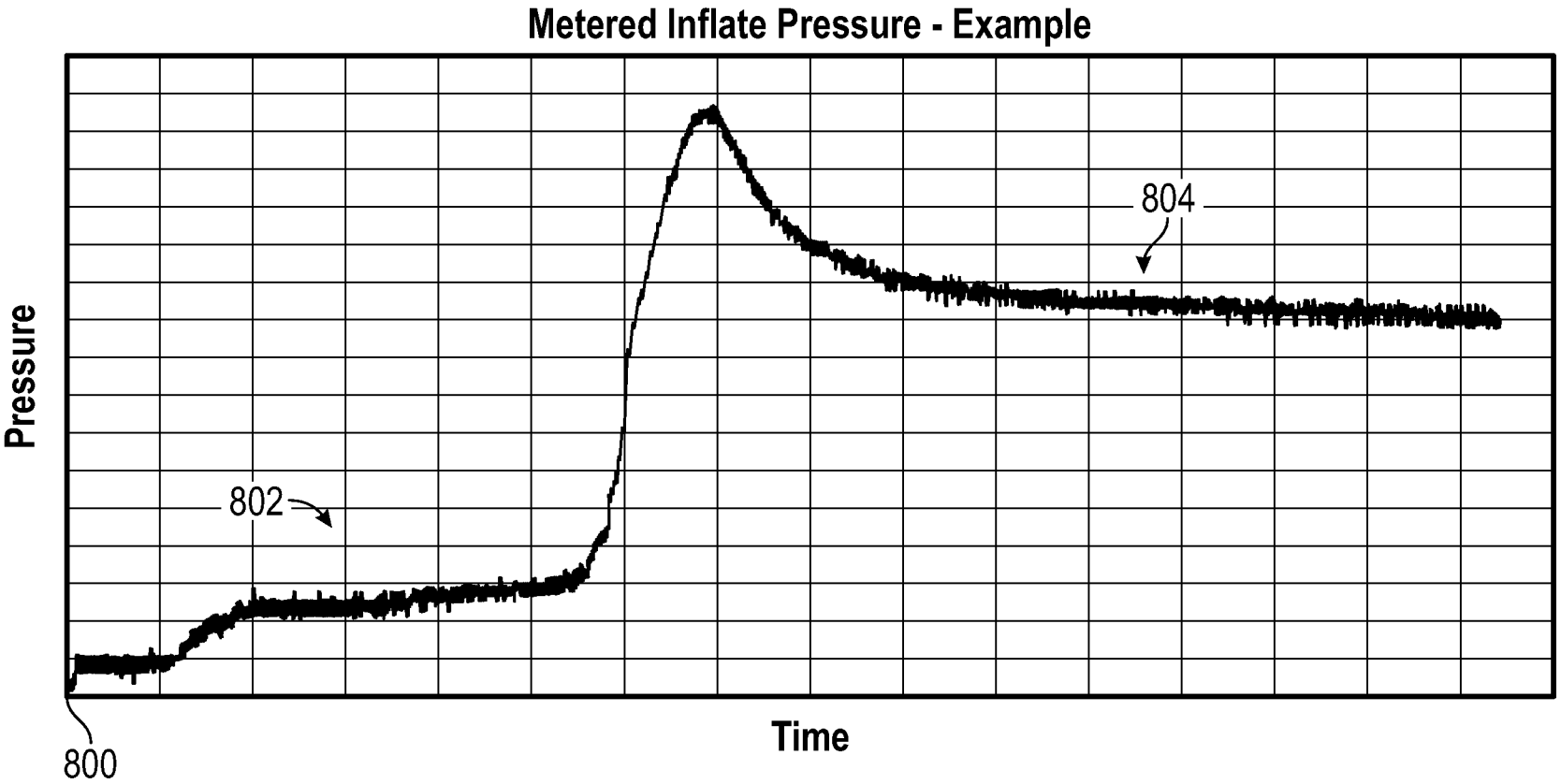
FIG. 8 illustrates a plot of pressure versus time at of inflation pressure provided by the inflation tool, according to an embodiment

FIG. 8 illustrates a plot of pressure versus time at of inflation pressure provided by the inflation tool 100, according to an embodiment. As can be seen in the plot, the pressure begins at roughly zero, corresponding to ambient pressure, at 800. The charges, e.g., charges 132, 134, may then be ignited and the pressure slowly increases during a first time period 802. At the end of the first time period 802, the pressure on the piston 130 rapidly increases, but expulsion of the hydraulic fluid 124 is delayed by the flow-metering device 140, leading to a rapid increase in the inflation pressure. Thereafter, during an inflation period 804, the hydraulic fluid 124 is expelled through the flow-metering device 140 for as long as sufficient pressure on the piston 130 is maintained or until the hydraulic fluid is fully pressured out of the hydraulic chamber 122. Accordingly, the pressure and time at which the elevated pressure is available may be controlled by selection of a number of charges, a size of the flow metering device 140, or both.

The foregoing has outlined features of several embodiments so that those skilled in the art may better understand the present disclosure. Those skilled in the art should appreciate that they may readily use the present disclosure as a basis for designing or modifying other processes and structures for carrying out the same purposes and/or achieving the same advantages of the embodiments introduced herein. Those skilled in the art should also realize that such equivalent constructions do not depart from the spirit and scope of the present disclosure, and that they may make various changes, substitutions, and alterations herein without departing from the spirit and scope of the present disclosure.

What is claimed is:

1. A downhole tool, comprising:

a housing defining a charge chamber and a hydraulic chamber, the hydraulic chamber containing a hydraulic fluid;

a piston disposed in the hydraulic chamber, wherein the piston prevents the hydraulic fluid from communicating with the charge chamber, and wherein the piston is in communication with the hydraulic fluid and the charge chamber;

one or more charges disposed in the charge chamber, wherein the one or more charges are configured to ignite and thereby expand a gas in the charge chamber, thereby causing the piston to move from a first position to a second position; and a fluid-metering device coupled to the housing, wherein the fluid-metering device is configured to control a rate at which the hydraulic fluid is pressed out of the hydraulic chamber, and wherein the piston is configured to move from the second position to a third position in which the piston engages the fluid-metering device and/or the piston prevents the expanded gas from exiting out of the hydraulic chamber via the fluid-metering device.

2. The downhole tool of claim 1, wherein the housing comprises a first end proximal to the charge chamber, and a second end proximal to the hydraulic chamber, wherein the fluid-metering device is coupled to the second end of the housing.

3. The downhole tool of claim 2, further comprising an inflatable device coupled to the second end of the housing, wherein the inflatable device is configured to receive the hydraulic fluid and inflate an inflatable element using the hydraulic fluid.

4. The downhole tool of claim 3, wherein the inflatable device is a packer, and wherein the hydraulic fluid pressed out of the hydraulic chamber by the piston engages the inflatable element and presses the inflatable element radially outward.

5. The downhole tool of claim 3, wherein the first position is proximal to the charge chamber, and wherein the piston moving from the first position to the second position displaces the hydraulic fluid through the fluid-metering device and causes the inflatable element to inflate.

6. The downhole tool of claim 5, wherein a number of the plurality of charges is configured to produce a predetermined inflation pressure.

7. The downhole tool of claim 6, wherein the piston is further configured to move from the second position to the third position in which the piston engages the fluid-metering device and prevents the expanded gas from exiting out of the hydraulic chamber via the fluid-metering device after the inflatable device is decoupled from the housing.

8. The downhole tool of claim 7, wherein at least some of the hydraulic fluid remains in the inflatable device after the inflatable device is decoupled from the housing.

9. The downhole tool of claim 7, wherein moving the piston to the third position causes the inflatable device to be decoupled from the housing.

10. The downhole tool of claim 1, wherein the one or more charges comprises a plurality of charges positioned in series in the charge chamber.

11. The downhole tool of claim 1, wherein the fluid-metering device comprises an orifice sized to restrict a fluid flow rate of the hydraulic fluid therethrough.

12. A method, comprising:

charging an inflation tool using one or more charges and a hydraulic fluid;

connecting the inflation tool to an inflatable device;

deploying the inflation tool and the inflatable device into a wellbore; and activating the inflation tool by igniting the one or more charges, wherein activating the inflation tool:

forces at least some of the hydraulic fluid into the inflatable device, wherein at least some of the hydraulic fluid that is forced into the inflatable device presses an inflatable element radially outward into engagement with a surrounding tubular; and causes the inflation tool to be decoupled from the inflatable device, which causes a piston of the inflation tool to seal an end of the inflation tool, such that a residual inflation pressure is contained within the inflation tool.

13. The method of claim 12, further comprising removing the inflation tool from the wellbore after activating the inflation tool, and wherein removing the inflation tool from the well does not remove the inflatable device from the well.

14. The method of claim 13, wherein the method further comprises bleeding the residual inflation pressure from within the inflation tool after removing the inflation tool from the well.

15. The method of claim 14, wherein bleeding the residual inflation pressure comprises rupturing a frangible disk.

16. The method of claim 12, wherein activating the inflation tool further comprises forcing at least some of the hydraulic fluid through a flow-metering device of the inflation tool, wherein the flow-metering device is configured to slow a flow of the hydraulic fluid into the inflatable device.

17. The method of claim 12, further comprising selecting a number of the one or more charges provided in the inflation tool based on an inflation pressure, a time at which an inflation pressure is to be supplied, or both.

18. The method of claim 12, where activating the inflation tool by igniting the one or more charges comprises causing:

a piston in a hydraulic chamber to force a hydraulic fluid in the hydraulic chamber out of the hydraulic chamber via a flow-metering device;

the hydraulic fluid to enter the inflatable device after passing through the flow-metering device;

the hydraulic fluid to overcome a biasing force on a poppet-valve element so as to inflate the inflatable element;

shear a pin holding a release piston in place;

move the release piston away from a collet; and deflect the collet so as to release the inflation tool from the inflation device.

19. A downhole tool, comprising:

a housing defining a charge chamber and a hydraulic chamber;

a piston disposed in the hydraulic chamber, wherein the piston prevents a hydraulic fluid in the hydraulic chamber from communicating with the charge chamber, and wherein the piston is in communication with the hydraulic fluid and the charge chamber;

a release piston disposed in the housing;

a collet disposed in the housing;

an inflatable device coupled to the housing; and one or more charges disposed in the charge chamber, wherein, in response to igniting the one or more charges, a pin holding the release piston in place shears, allowing the release piston to move away from the collet, which causes the collet to deflect so as to release the housing from the inflatable device.

20. The downhole tool of claim 19, wherein the one or more charges comprises a plurality of charges positioned in series in the charge chamber.

21. The downhole tool of claim 19, wherein the inflatable device comprises an inflatable element, wherein the piston is configured to move from a first position that is proximal to the charge chamber, to a second position in the hydraulic chamber by pressure generated by igniting the one or more charges, and wherein the piston moving from the first position to the second position displaces the hydraulic fluid and causes the inflatable element to inflate.

* * * * *